US006199739B1

(12) United States Patent
Mukoyama et al.

(10) Patent No.: US 6,199,739 B1
(45) Date of Patent: Mar. 13, 2001

(54) NAIL GUNS HAVING MEANS FOR PREVENTING THE NAIL DRIVING OPERATION

(75) Inventors: Kenji Mukoyama; Takahiro Sakaguchi; Nobuyuki Kakuda; Jiro Oda, all of Anjo (JP)

(73) Assignee: Makita Corporation, Anjo (JP)

( * ) Notice: Subject to any disclaimer, the term of this patent is extended or adjusted under 35 U.S.C. 154(b) by 0 days.

(21) Appl. No.: 09/371,523

(22) Filed: Aug. 10, 1999

(30) Foreign Application Priority Data

Aug. 10, 1998 (JP) ..... 10-226103

(51) Int. Cl.[7] ..... B27F 7/17
(52) U.S. Cl. ..... 227/8; 227/120; 227/130
(58) Field of Search ..... 227/8, 120, 142, 227/130

(56) References Cited

U.S. PATENT DOCUMENTS 3,198,412 * 8/1965 Roosa ..... 227/8
3,606,128 9/1971 Cast et al. ..... 227/8
3,615,049 * 10/1971 Obergfell et al. ..... 227/8
3,858,781 * 1/1975 Obergfell et al. ..... 227/8
4,197,974 * 4/1980 Morton et al. ..... 227/8
4,389,012 * 6/1983 Grikis et al. ..... 227/120
4,597,517 * 7/1986 Wagdy ..... 227/8
5,180,091 * 1/1993 Ota ..... 227/8
5,816,468 * 10/1998 Yang ..... 227/8

FOREIGN PATENT DOCUMENTS 2-28007 7/1990 (JP) .

* cited by examiner

*Primary Examiner*—Peter Vo
*Assistant Examiner*—Jim Calve
(74) *Attorney, Agent, or Firm*—Dennison, Scheiner, Schultz & Wakeman

(57) ABSTRACT

A nail gun includes a contact arm that is movable relative to a nail gun body between an upper first stroke end position and a lower second stroke end position. The contact arm may prevent the nails from being driven when it is in the first stroke end position. A nail driving prevention device includes an engaging member that is movable to enter the moving path of the contact arm so as to prevent the contact arm from moving from the first stroke end position toward the second stroke end position when the number of the nails in a nail magazine has been reduced to a predetermined number. A deviating device is operable to change the moving course of the engaging member away from the moving path of the contact arm when the contact arm is positioned above the first stroke end position.

6 Claims, 10 Drawing Sheets

NAIL GUNS HAVING MEANS FOR PREVENTING THE NAIL DRIVING OPERATION

BACKGROUND OF THE INVENTION

1. Field of the Invention

The present invention relates to nail guns having a contact arm vertically movable relative to a nail gun body and a device that can prevent the movement of the contact arm toward the upper stroke end position when the number of nails stored in a magazine is less than a predetermined number.

2. Description of the Related Art

A known nail gun has a contact arm that is vertically movable along a driver guide. The drive guide extends downwardly from a nail gun body and has a nail discharge opening at its lower end position. The contact arm is normally held at a lower stroke end position, in which the contact arm extends downward from the lower end position of the driver guide and prevents a trigger from operating to drive nails. When an operator presses the nail gun against a workpiece, the contact arm may contact the workpiece before the driver guide contacts the workpiece. As a result, the contact arm moves upward along the driver guide. When the lower end position of the contact arm contacts the workpiece, the contact arm reaches the upper stroke end position, in which the trigger is permitted to operate for driving the nails.

On the other hand, a pusher is associated with the magazine for feeding the nails one after another into the driver guide. An "idle driving prevention device" typically comprises an engaging member that is connected to the pusher. An "idle driving prevention device" means a mechanism that prevents the nail gun from driving nails when the magazine is empty or nearly empty. The pusher moves toward the driver guide as the number of nails stored in the magazine is reduced. When the number of nails stored in the magazine is reduced to a predetermined number, the engaging member enters the moving path of the contact arm to prevent the contact arm from moving upward from its lower stroke end position. As a result, the nail driving operation can be prevented when the magazine is empty or nearly empty.

However, the engaging member of the idle driving prevention device moves to enter the moving path of the contact arm with the pusher instantaneously with the driving operation of the nail that has been fed immediately before the predetermined number has reached. At that moment, the contact arm is positioned at the upper stroke end position or a position slightly below the upper stroke end position. Therefore, the engaging member may abut the contact arm. As a result, the engaging member may interfere with the contact arm and lock the same in the position above the lower stroke end position. When this lockup occurs, the contact arm may not return to the lower stroke end position and therefore, the nail driving operation cannot be smoothly performed.

The above situation could possibly be caused every time in which a nail is driven that is immediately before the predetermined last nail in the magazine (which may be zero nails). Therefore, the above situation is a significant problem to be solved.

In order to ensure that the contact arm may return to the lower stroke end position against the interference with the engaging member, it is possible to increase the biasing force of the spring that biases the contact arm. However, if the biasing force of the spring has been increased, a great pressing force is required to move the contact arm from the lower stroke end position to the upper stroke end position. As a result, another problem may be caused, because the operability of the nail gun is more cumbersome.

Another significant problem with known nail guns occurs when several nails are driven into the same workpiece with the driving position in turn shifted to a different positions adjacent thereto. In this situation, the operator may frequently perform a "dragging" driving operation in the following manner:

After one nail driving operation has been completed, the operator shifts the nail gun to the next driving position with the contact arm held in contacted with the workpiece or at least the contact arm is not permitted to completely return to the lower stroke end position. When the nail gun reaches the next driving position, the operator continues to press the nail gun to move the contact arm to the upper most position, so that the operator can drive the next nail by the operation of the trigger.

If the driving operation of the nail is continuously performed several times and the contact arm has not been completely returned to the lower stroke end position as described above, it is inevitable that the engaging member will abut the contact arm and lockup the same. Thus, because the engaging member enters the moving path of the contact arm when the number of the nails in the magazine has been reduced to a predetermined number, the contact arm may still be locked by the engaging member even if the previous problem has been solved.

SUMMARY OF THE INVENTION

It is, accordingly, one object of the present invention to teach improved nail guns that having improved means for preventing the nail driving operation when the number of nails in the magazine is less than a predetermined number. Preferably, the above-noted problems are solved or at least mitigated.

According to a first aspect of the present invention, a nail gun is taught that includes a contact arm, which can move relative to a nail gun body between an upper first stroke end position and a lower second stroke end position. The contact arm may prevent the nails from being driven when the contact arm is in the first stroke end position. A nail driving prevention device is provided and may include an engaging member that can move to enter the moving path of the contact arm so as to prevent the contact arm from moving from the first stroke end position toward the second stroke end position when the number of the nails in a nail magazine has been reduced to a predetermined number. A deviating device may be operable to change the moving path of the engaging member away from the moving path of the contact arm when the contact arm is positioned above the first stroke end position.

Consequently, the engaging member of the nail driving prevention device preferably does not interfere with the contact arm, even when the contact arm is positioned above the lower first stroke end position. As a result, the contact arm can easily return to the first stroke end position by its own weight or by use of a small biasing force.

Thus, even when the number of the nails in the magazine has been reduced to the predetermined number during a continuous driving operation, in which the contact arm is maintained in a position above the first stroke end position, the contact arm preferably does not lockup with the engaging member. Therefore, the contact arm can automatically return to the lower stroke end position when the nail gun is lifted and the contact arm is moved away from the workpiece. As a result, further nail driving operations can readily be performed after new nails have been inserted into the magazine. Consequently, the engaging member and the contact arm preferably are not damaged or deformed. In addition, the operability of the nail driving operation can be improved.

In particular, because the engaging member does not stop its movement, but instead, deviates from the contact arm, a pusher can still be used as an actuator of the engaging member. Therefore, a separate drive device is not required for the engaging member. As a result, the construction of the nail gun incorporating the above improvements may be relatively simple.

According to a second aspect of the present invention, a nail gun is taught that may include a contact arm returning device for temporary applying a force to the contact arm in a direction toward the first stroke end position after the nail has been driven. In this case, the contact arm can reliably return to the first stroke end position for the next driving operation immediately before the engaging member of the nail driving prevention device enters the moving path of the contact arm. Otherwise, the contact arm may forcibly be returned to the first stroke end position against the abutting force that may be applied to the contact arm by the engaging member. The contact arm returning device does not apply a returning force to the contact arm when the contact arm is to be moved to the upper stroke end position to permit the driving operation of the nail. Therefore, the operability of the nail gun can be improved.

Other objects, features and advantages of the present invention will be readily understood after reading the following detailed description together with the accompanying drawings and the claims.

DETAILED DESCRIPTION OF THE INVENTION

Figure 1:
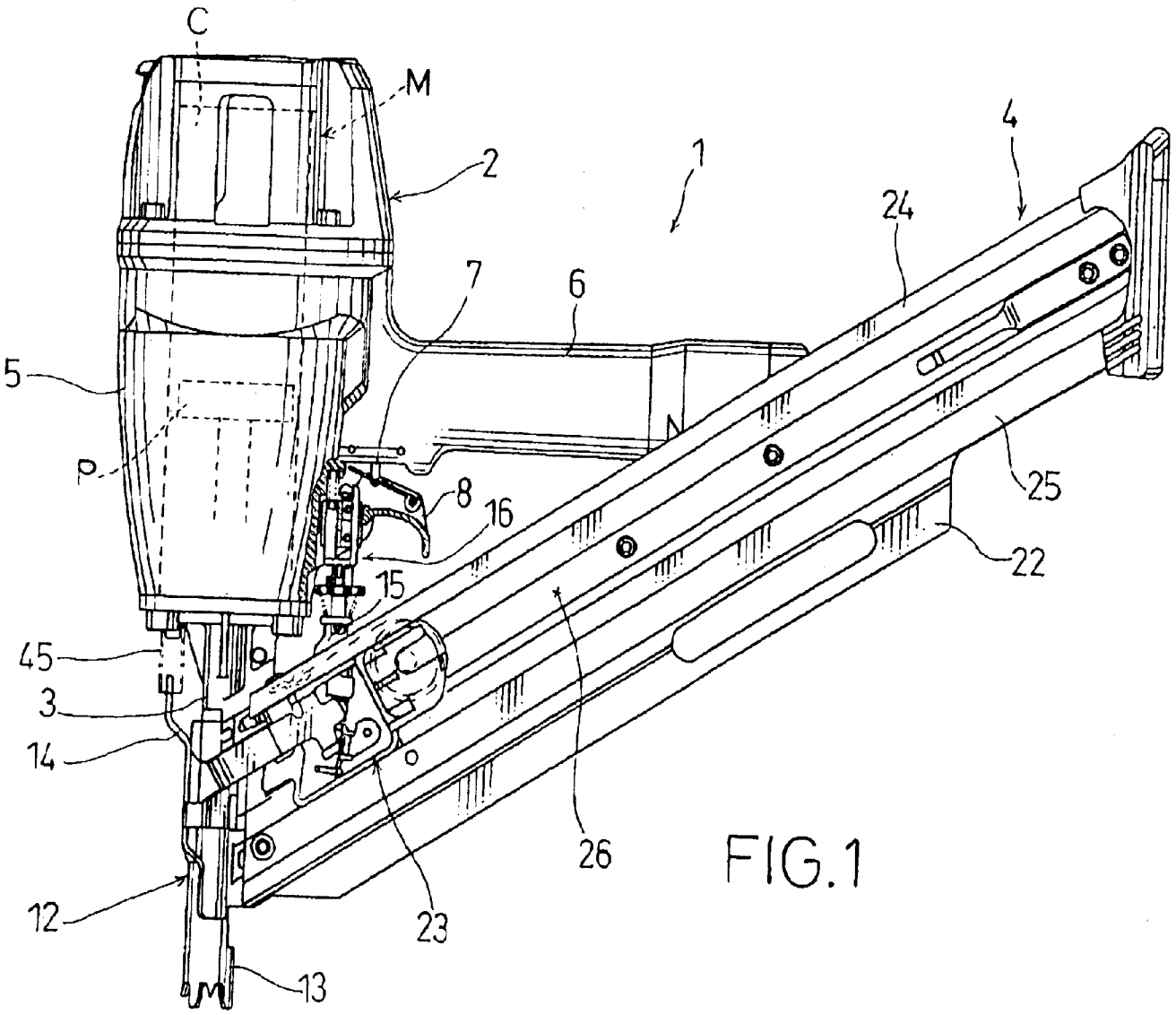
FIG. 1 is a side view of a representative embodiment of an improved nail gun.

According to a first aspect of the present invention, a nail gun is taught that may include a body, a driver for driving nails, a drive mechanism for the driver, a magazine for storing the nails, and a contact arm movable relative to the body between an upper first stroke end position and a lower second stroke end position. The contact arm is operable to prevent the nails from being driven when it is in the first stroke end position. The nail gun may further include an nail driving prevention device that has an engaging member, which device may prevent the nail gun from performing nail driving operations when the magazine is empty or nearly empty. The engaging member may enter the moving path of the contact arm to prevent the contact arm from moving from the first stroke end position toward the second stroke end position when the number of the nails in the magazine has been reduced to a predetermined number. The nail gun may further include a deviating device that is operable to change the moving course of the engaging member away from the moving path of the contact arm, when the contact arm is positioned above the first stroke end position.

Preferably, the nail gun further includes a driver guide and a pusher. The driver guide may be mounted on the body for guiding the driver guide and may have a nail discharge opening at its lower end position. The pusher may be operable to feed the nails one after another from the magazine into the driver guide. Preferably, the engaging member may be mounted on the pusher and may be movable to enter the moving path of the contact arm in such a manner that it crosses the moving path.

In one representative embodiment, the deviating device may include a hinge, a biasing member and a cam surface. The hinge may connect the engaging member to the pusher such that the engaging member is pivotable between a first position directed toward the moving path of the contact arm and a second position directed to deviate from the direction toward the moving path. The biasing member may serve to normally hold the engaging member to be directed to the first direction. The cam surface may be formed on the engaging member for cooperation with the contact arm. When the engaging member moves toward the moving path or the contact arm when the contact arm is in a position upward of the first stroke end position, the cam surface may contact and slide along an outer surface of the contact arm, so that the engaging member may pivot from the first position to the second position against the biasing force of the biasing member.

Preferably, a backup wall may be provided for backing the engaging member on the side opposite to the contact arm when the engaging member enters the moving path of the contact arm. The backup wall may be formed on the driver guide.

In one representative embodiment, the contact arm may be slidably movable along the driver guide.

According to a second aspect of the present invention, a nail gun is taught that may include a body, a driver for driving nails, a drive device for the driver, a magazine for storing the nails, and a contact arm movable relative to the body between an upper first stroke end position and a lower second stroke end position. The contact arm is operable to prevent the nails from being driven when the contact arm is in the first stroke end position. The nail gun may further include a nail driving prevention device that can prevent the contact arm from moving from the first stroke end position toward the second stroke end position when the number of the nails in the magazine has been reduced to a predetermined number. The nail gun may further include a contact arm returning device for temporary applying a force to the contact arm in a direction the first stroke end position after the nail has been driven.

In a preferred representative embodiment, the drive device of the driver is a fluid pressure drive device, and the contact arm returning device may utilize the fluid pressure from the drive device for applying the returning force.

Preferably, the fluid pressure may be air pressure, and the drive device may include a piston-cylinder mechanism and a return chamber. The piston-cylinder mechanism may include a cylinder and a piston that is connected to the driver and that can reciprocally move within the cylinder. The return air chamber may store a volume of air for returning the piston to an upper stroke end position after the piston has moved to the lower stroke end position to drive the nail. The contact arm returning device may include a plunger device that has a plunger rod. The plunger rod may be connected to the contact arm and may be operated by the pressure within the return air chamber.

Each of the additional features and method steps disclosed above and below may be utilized separately or in conjunction with other features and method steps to provide improved nail guns and methods for designing and using such nail guns. Representative examples of the present invention, which examples utilize many of these additional features and method steps in conjunction, will now be described in detail with reference to the attached drawings. This detailed description is merely intended to teach a person of skill in the art further details for practicing preferred aspects of the present teachings and is not intended to limit the scope of the invention. Only the claims define the scope of the claimed invention. Therefore, combinations of features and steps disclosed in the following detail description may not be necessary to practice the invention in the broadest sense, and are instead taught merely to particularly describe some representative examples of the invention.

A first representative embodiment of a pneumatic nail gun is shown in FIGS. 1 to 9 and is designated by reference numeral 1. The nail gun 1 may includes a body 2, a driver guide 3 and a nail storing magazine 4. The body 2 may have a vertical piston-cylinder mechanism M disposed therein. The driver guide 3 may extend downward from the front lower end of the body 2. The magazine 4 may be connected between the driver guide 3 and the rear end of the body 2.

The body 2 may have a main portion 5 for accommodating the piston-cylinder mechanism M and have a handle 6 that extends horizontally rearward from the rear side of the main portion 5. A trigger 8 may be pivotally mounted on the lower portion of the handle 6 adjacent to the main portion 5, so that the trigger 8 can be operated to actuate a trigger valve having a stem 7.

Figure 4:
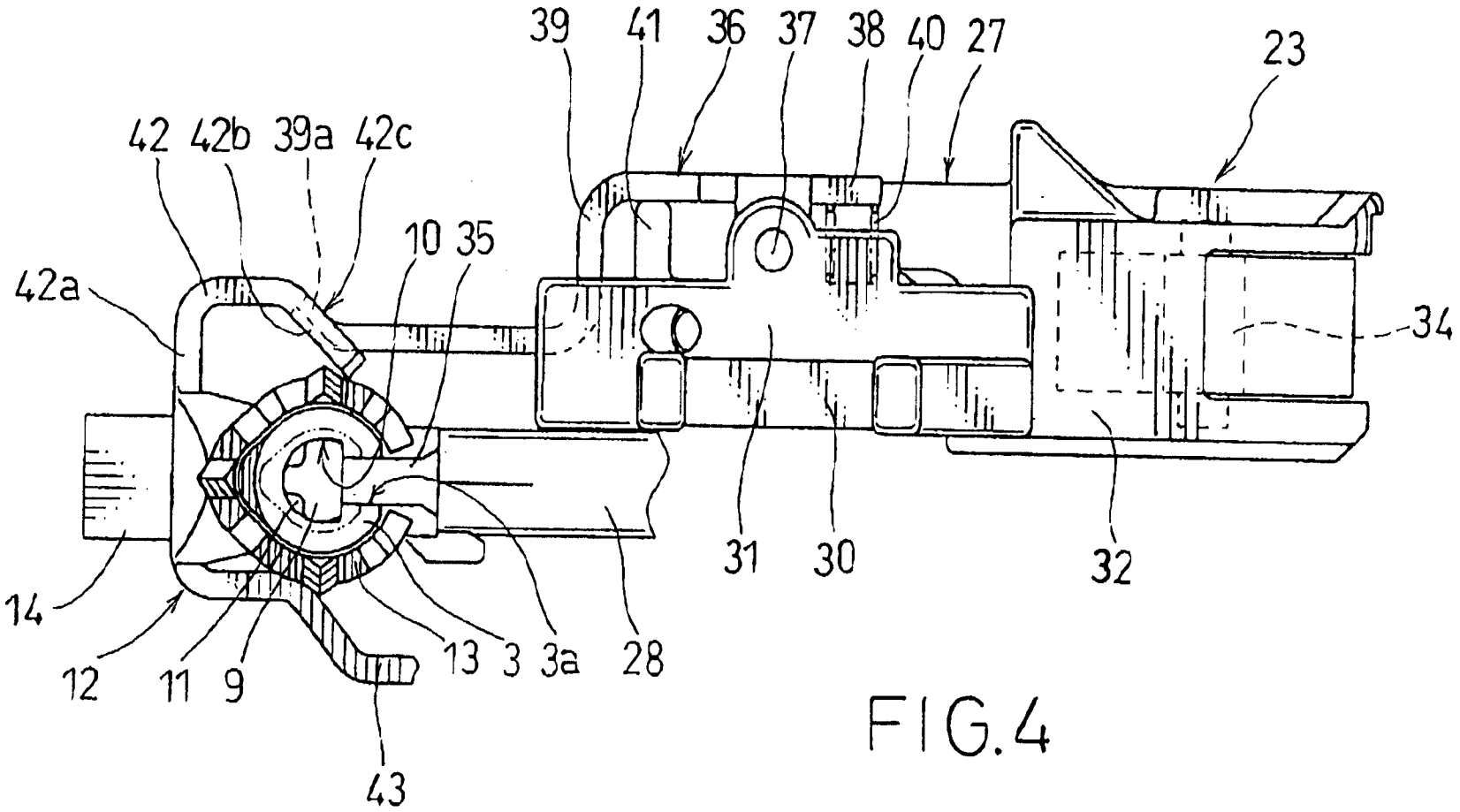
FIG. 4 is a bottom view of the pusher and the engaging member and also showing a driver guide and a contact arm.

As shown in FIG. 4, the driver guide 3 may have a guide channel 10 formed therein for guiding a driver 9 that is connected to a piston P of the piston-cylinder mechanism M. The guide channel 10 opens to the outside through a nail discharge opening 11 that is formed at the lower end of the drive guide 3.

A contact arm 12 may be vertically slidably movable along the driver guide 3 and may have a substantially cylindrical abutting portion 13, a biasing rod 14 and an actuation arm 15. The abutting portion 13 may have a lower end for abutment to a workpiece (not shown). The biasing rod 14 may be connected to the upper end of the abutting portion 13 and may be bent to have a substantially S-shaped configuration. The actuation arm 15 may be connected to the left side (back side as viewed in FIGS 1 and 2) of the abutting portion 13. A trigger control mechanism 16 may be provided between the actuation arm 15 and the trigger 8, so that the trigger valve can be actuated by the trigger 8 in response to the vertical position of the actuation arm 15. A compression coil spring 45 may be interposed between the biasing rod 14 and the bottom of the main portion 5 of the body 2, so that the contact arm can be normally held at a lower stroke end position as shown in FIGS. 1 and 2.

The trigger control mechanism 16 may include a control member 19, a coupling mechanism 20 and an idler plate 21. As shown in FIG. 2, the control member 19 may be vertically slidably supported by a guide member 17 that is mounted on the rear portion of the body 2. In addition, a compression coil spring 18 may serve to downwardly bias the control member 19. The coupling mechanism 20 may serve to connect the control member 19 to the actuation arm 15 such that the distance between them can be adjusted. The idler plate 21 may be pivotally mounted on the trigger 8 on the side adjacent to the stem 7 of the trigger valve. When the contact arm 12 is in the lower stroke end position as shown in FIGS. 1 and 2, the lower end of the contact arm 12 extends downward from the lower end of the driver guide 3. In this situation, the idler plate 21 may be free to pivot relative to the control member 19, so that the stem 7 is not be pushed by the trigger 8 even when the trigger 8 has been pulled by the operator. When the contact arm 12 has been pressed against the workpiece, the contact arm 12 may move upward against the biasing force of the compression coil spring 45, so that the contact arm 12 reaches an upper stroke end position, in which the lower end of the abutting portion 13 is positioned at substantially the same level as the lower end of the driver guide 3. At the same time, the control member 19 may move upward against the biasing force of the compression coil spring 18, so that the control member 19 contacts the idler plate 21 at a control portion 19*a*. As a result, the idler plate 21 may be prevented from pivoting downward as viewed in FIG. 2. Consequently, the stem 7 may be pressed by the trigger 8 to open the trigger valve when the trigger 8 is pulled by the operator. Although the compression coil spring 18 may indirectly bias the contact arm 12 via the control member 19, the coupling mechanism 20 and the actuation arm 15, the biasing force applied to the contact arm 12 by the spring 18 may be determined to be smaller than the biasing force applied to the contact arm 12 by the compression spring 45. Therefore, the upward movement of the contact arm 12 may be performed substantially against the biasing force of the spring 45.

The construction of the magazine 4 will now be explained with reference to FIG. 1. The magazine 4 may generally include a magazine body 22 and a pusher 23. The magazine body 22 stores nails in a form of a nail stick (comprising nails arranged in parallel with each other and connected in series with each other by means of wires or the like). The pusher 23 serves to push the nail stick into the guide channel 10 of the drive guide 3. The magazine body 22 may have upper and lower edges, on which a pair of upper and lower parallel rails 24 may be formed. Each of the rails 24 and 25 has a substantially U-shaped cross-section and may provide a guide for the nail stick. The front end of the magazine body 22 communicates with a vertical slot 3*a* formed in the rear side wall of the driver guide 3 (see FIG. 4). A nail feeding channel 26 may be formed in the magazine body 22 and extend from the rear side of the magazine body 22 to the drive guide 3 in a direction slightly inclined downward relative to the horizontal direction.

Figure 2:
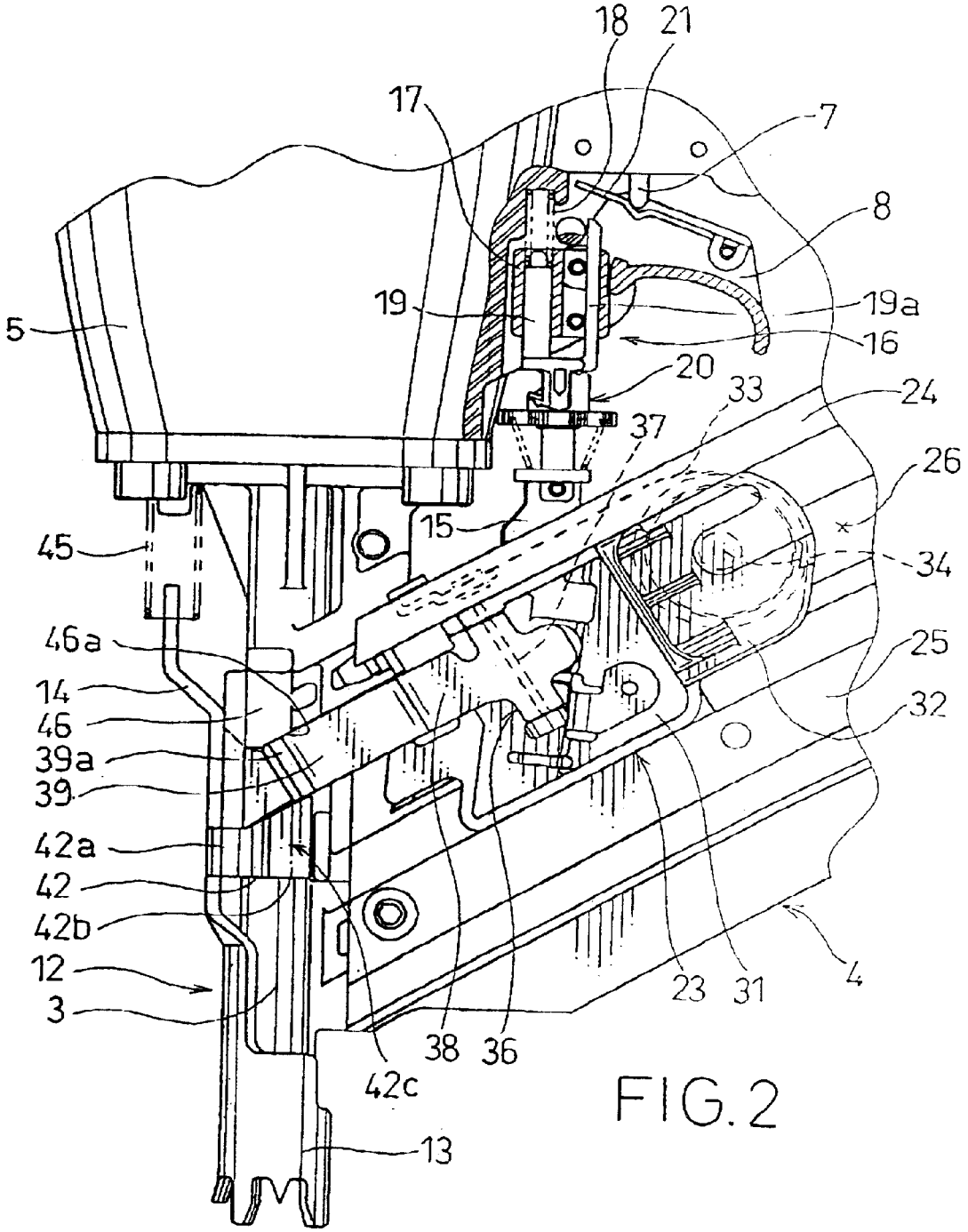
FIG. 2 is an enlarged view of a part of FIG. 1.
Figure 3:
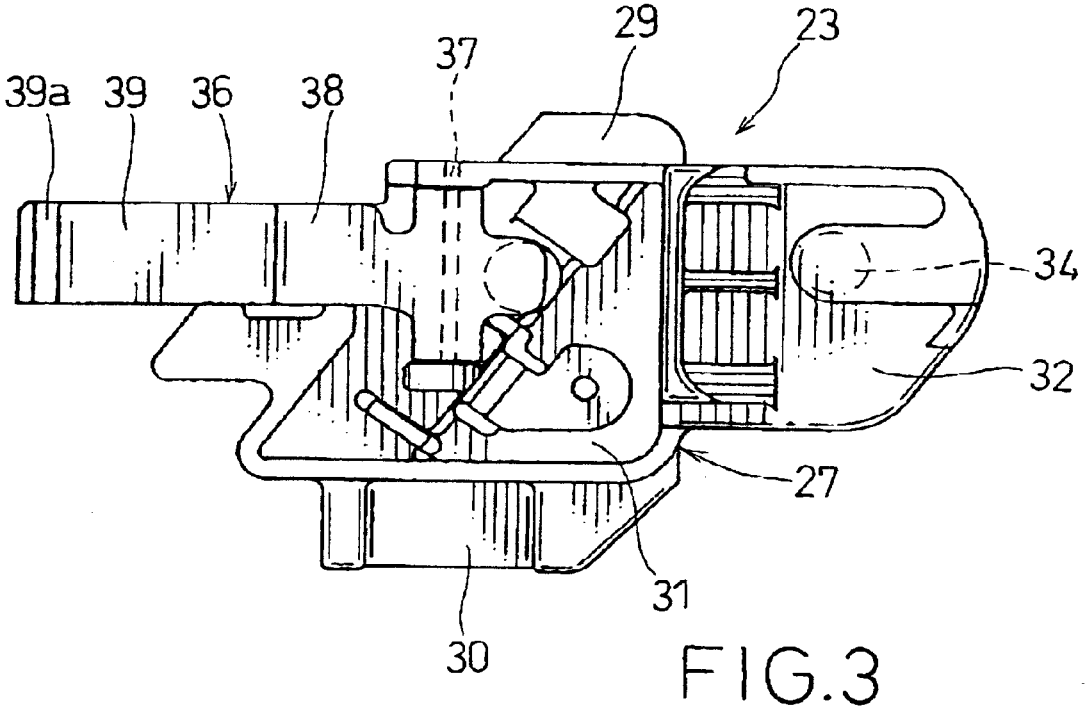
FIG. 3 is a side view of a pusher and an engaging member associated therewith of the nail gun.

As shown in FIGS. 2 to 4, the pusher 23 may include a pusher lever 27 and a pusher rod 28 that is connected to the lateral side of the pusher lever 27. The pusher lever 27 may have a base portion 31 and a spring mounting portion 32 that is formed integrally with the rear part of the base portion 31.

The base portion 31 may have upper and lower edges 29 and 30 that slidably engage the guide rails 24 and 25 of the magazine body 22, respectively. As shown in FIG. 2, the spring mounting portion 32 may have a core shaft 34. A spiral spring 33 may have one end secured to the core shaft 33 and may be partly wound about the core shaft 34. The other end of the spiral spring 33 may extend forward along the inside of the upper guide rail 24 and may be secured to the inner surface of the front end of the upper guide rail 24.

As shown in FIG. 4, the pusher rod 28 may have a protrusion 35 that may enter the guide channel 10 of the driver guide 3 through the slot 3*a*. The protrusion 35 may serve to push the rear end of the nail stick, so that one nail is fed into the guide channel 10 after each stroke movement of the driver guide 3. When the nail gun is in the state shown in FIG. 4, all the nails have been driven, so that the magazine 4 is empty.

Referring to FIGS. 2 to 4, an engaging member 36 may be pivotally mounted on the base portion 31 of the pusher lever 27 by means of a pin 37 (see FIG. 4). The pin 37 extends substantially at a right angle with respect to the longitudinal direction of the nail feeding channel 26. Therefore, the axis of the pin 37 is slightly inclined forward relative to the vertical direction. The engaging member 36 may include a flat plate-like portion 38 that is pivotally supported by the pin 37. The engaging member 36 may also have an engaging portion 39 that extends from the plate-like portion 38 and that has a substantially L-shaped configuration. A compression coil spring 40 may be interposed between the base portion 31 and a part of the plate-like portion 38 positioned rearward of the pivotal support point by the pin 37. Therefore, the engaging member 36 may be biased in the counterclockwise direction as viewed in FIG. 4. The engaging member 36 may have a front end 39*a* that is inclined laterally outward (upward as viewed in FIG. 4) by an angle of about 45° from the engaging member 36. A stopper 41 may be formed on the base portion 31 in a position forward of the pivotal support point by the pin 37 and may extend laterally outward from the base portion 31. The stopper 41 may serve to contact the plate-like portion 38 of the engaging member 36, so that the plate-like portion 38 and a front part of the engaging portion 39 having the front end 39*a* may be held substantially in parallel to the moving direction of the pusher 23 against the biasing force of the spring 40.

A pair of arm portions 42, 43 may be formed on the biasing rod 14 of the contact arm in such a manner that they embrace the driver guide 3 from opposite sides. The arm portion 42 positioned upward of the arm portion 43 as viewed in FIG. 4 may include a substantially L-shaped extension 42*a* and an inwardly bent part 42*b*. The extension 42*a* may extend outward from the biasing rod 14. The bent part 42*b* may extend further from the extension 42*a* and may be bent toward the driver guide 3.

The bent part 42*b* may have an upper side surface that extends substantially in the with the lower side surface of the front portion 39*a* of the engaging portion 39 of the engaging member 36 when the contact arm 12 is in the lower stroke end position as shown in FIGS. 1 and 2. As a result, when the number of the nails in the magazine has been reduced to a predetermined number (zero in this representative embodiment), the front portion 39*a* may enter the moving path of the arm portion 42 of the contact arm 12, so that the lower side surface of the front portion 39*a* opposes and substantially contacts the upper side surface of the bent part 42*b*.

However, in general, the contact arm 42 is formed by cutting and bending a flat metal plate. Therefore, the upper side surface of the bent part 42*b* may not extend exactly in parallel to the lower side surface of the front portion 39*a* of the engaging portion 39 but may be inclined by a small angle in the left side direction. As a result, when the upper side surface of the bent part 42*b* contacts the lower side surface of the front portion 39*a* by the upward movement of the contact arm 12, a moment may be produced to move the front portion 39*a* in the left side direction. As a result, the engaging member 36 may pivot relative to the base portion 31 of the pusher lever 27 and may be disengaged from the bent part 42*b* of the arm portion 42.

Figure 5:
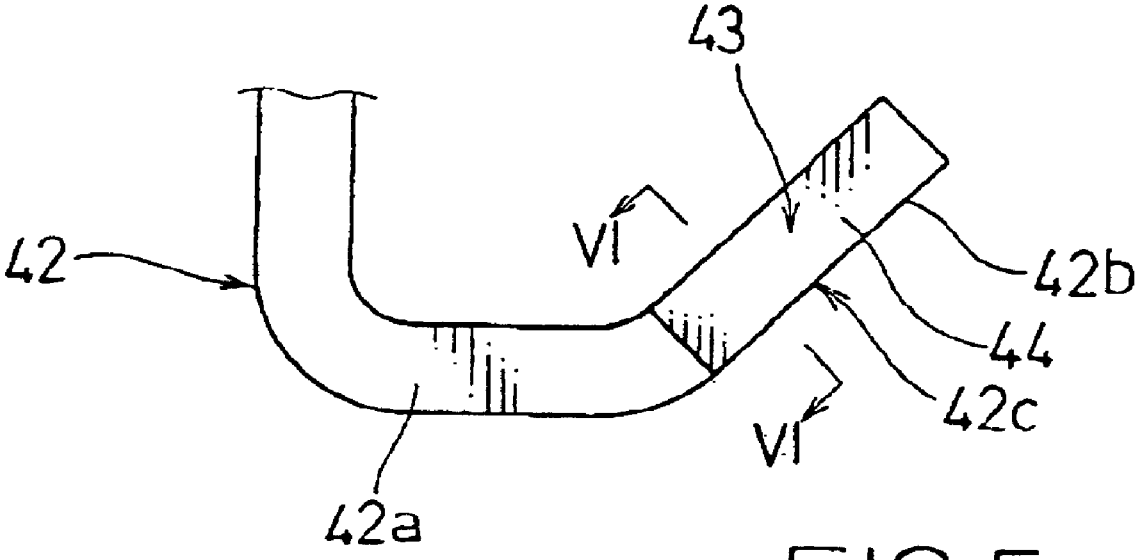
FIG. 5 is an enlarged plan view of one arm of the contact arm for engagement with the engaging member.
Figure 6:
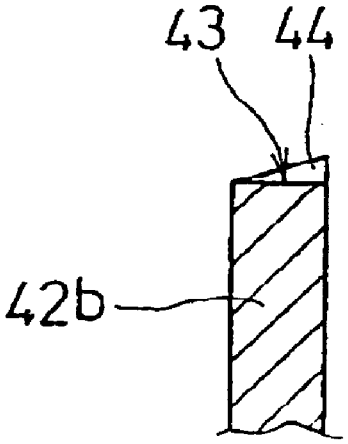
FIG. 6 is a sectional view taken along line VI—VI in FIG. 5.

In order to prevent such disengagement of the engaging member 36 from the arm portion 42 or the contact arm 12, a notch 44 may be formed in the upper side surface of the bent part 42*b* of the arm portion 42 as shown in FIGS. 5 and 6. The notch 44 may have a bottom surface 43 that extends in parallel to the lower side surface of the front part 39*a*. Therefore, moment will be produced to disengage the engaging member 36 from the contact arm 12.

Figure 7:
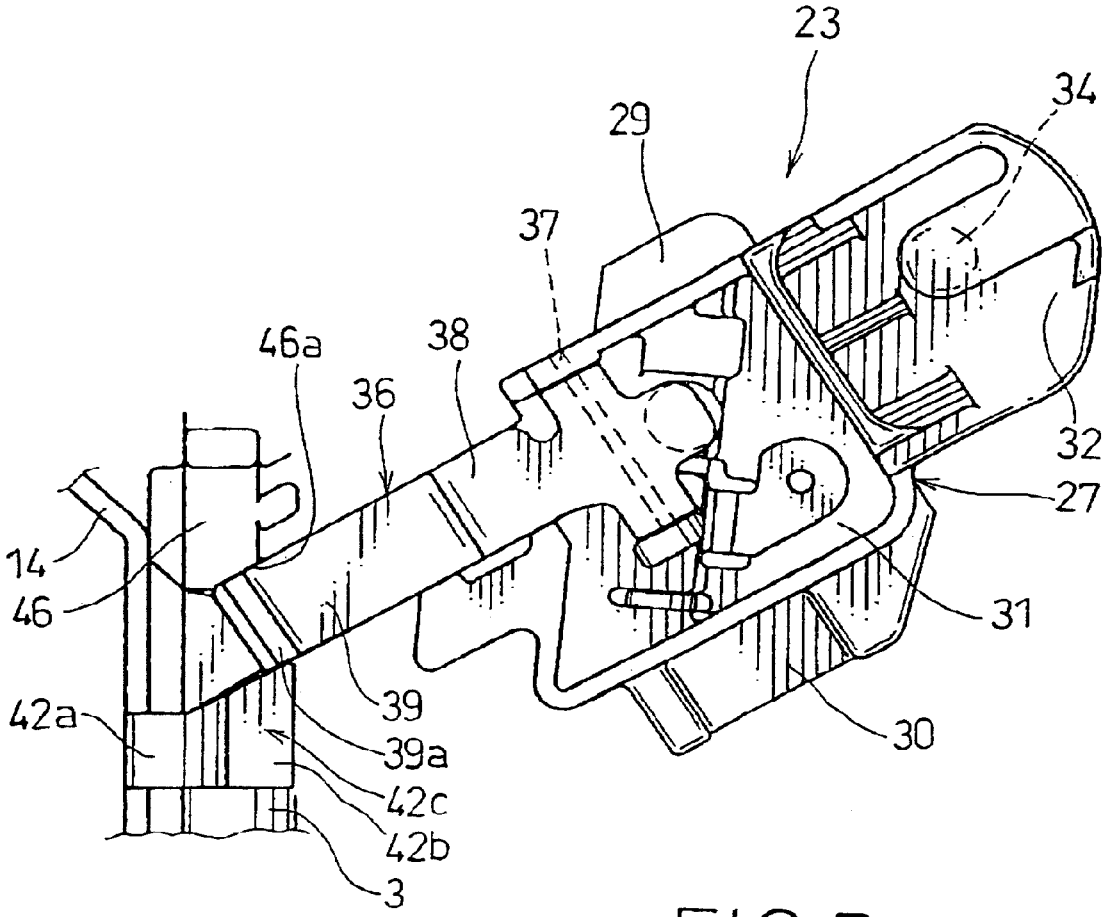
FIG. 7 is a side view showing the engagement of the engaging member with the contact arm.

As shown in FIGS. 1 and 2, the drive guide 3 may have a raised wall part 46 that is formed in substantially the central position of the drive guide 3 in the longitudinal direction. The wall part 46 may have a thickness greater than the remaining portion of the driver guide 3, so that the wall part 46 protrudes outward from the lateral wall of the drive guide 3. As shown in FIG. 7, the wall part 46 may have an inclined lower edge 46*a* that extends substantially in parallel to the upper side surface of the front part 39*a* of the engaging portion 39 as well as the upper side surface of the bent part 43*b* of the arm portion 42. When the contact arm 12 is in the lower stroke end position, the lower edge 46*a* may be spaced from the upper side surface of the bent part 42*b* of the arm portion 42 by a distance that is substantially equal to or slightly greater than the width of the engaging portion 36.

The operation of the above representative embodiment will now be explained.

Prior to driving a nail or when contact arm 12 is not pressed against the workpiece, the contact arm 12 typically will be held in the lower stroke end position by the biasing force of the compression coil spring 46. Therefore, the stem 7 of the trigger valve cannot be pushed or the trigger valve cannot be opened even when the trigger 8 has been pulled by the operator.

When the operator presses the abutting portion 13 of the contact arm 12 against the workpiece, the contact arm 12 typically will be moved to the upper stroke end position. Therefore, the stem 7 can be pushed by the trigger 8 or the trigger valve can be opened. The piston-cylinder mechanism M within the body 2 may then operate to move the driver 9 downward. Therefore, the nail fed into the guide channel 10 of the drive guide 3 can be driven out from the opening 11 at the lower end of the guide channel 10 into the workpiece. The next nail can be fed into the guide channel 10 by the pusher 10 as the driver 9 returns upward.

When the operator lifts the nail gun 1 to release the contact arm 12 from the pressing condition, the contact arm 12 can return to the lower stroke end position. As a result, the nail gun 1 returns to the state, in which the driving operation cannot be performed even if the trigger 8 has been pulled.

Thus, by repeatedly performing the operations of pressing the contact arm 12 against the workpiece, pulling the trigger 8, and releasing the contact arm 12 from the pressed condition, the nails stored in the magazine 4 can be fed one after another into the guide channel 10 so as to be driven into the workpiece.

The pusher 23 may move toward the driver guide 3 as the nails in the magazine 4 are driven into the workpiece or as the number of nails in the magazine 4 decreases. Because the engaging member 36 is mounted on the pusher lever 27, the engaging member 36 may move to follow the movement of the pusher 23.

When the nails in the magazine have decreased to a predetermined number, the engaging portion 39 of the engaging member 36 goes into the moving path of the contact arm 12 as shown in FIGS. 4 and 7. More specifically, the engaging portion 39 moves into the path of the contact arm 12 simultaneously with the nail that is immediately before the nail that has been predetermined to be the last nail in the magazine. When the contact arm 12 has been returned to the lower stroke end position, the engaging member 39 may go above the bent part 42*a* of the arm portion 42, so that the lower side surface of the engaging portion 39 opposes the upper side surface of the bent part 42*a*. Therefore, the contact arm 12 may be prevented from moving upward by the engaging member 36. Thus, the nail will not be driven even if the trigger 8 has been pulled. As a result, the engaging member 36 serves as a nail driving prevention device.

When the contact arm is in the lower stroke end position, the raised wall part 46 of the driver guide 3 may be spaced upward of the bent part 42*b* of the arm portion 42 by a distance corresponding to the width of the engaging portion 39. Therefore, the wall part 46 may oppose the upper side surface of the engaging portion 39 so as to substantially contact the same. Therefore, the wall part 46 may serve to back up the engaging portion 39 when the contact arm 12 has been pressed against the workpiece in the idle driving prevention mode. Thus, the engaging member 36 including the engaging portion 39 and its mounting portion on the pusher lever 27 by means of the pin 37 will not receive substantial impacts and should not be damaged. As a result, the engaging member 36 can reliably perform the nail driving prevention function, when the magazine is empty or nearly empty.

In addition, because the upper side surface of the bent part 42*b* of the contact arm 12 includes the notch 44 with horizontal bottom surface 43, the contact arm 12 applies the force to the engaging portion 39 only in the upward direction when the contact arm 12 has been lifted. Therefore, the engaging portion 39 should not pivot laterally, but instead, may be held in position by the compression coil spring 40. As a result, the engaging member 36 can reliably prevent the contact arm 12 from moving upward, so that the engaging member 36 can reliably perform the nail driving prevention function in this respect.

In case of the nail driving prevention device incorporating the engaging member 36 that follows the movement of the pusher 23 as in this representative embodiment, the engaging portion 39 may enter the moving path of the contact arm 12 substantially simultaneously with the nail that is immediately before the predetermined last nail. Therefore, in some cases, the engaging portion 39 may not enter the position above the bent part 42*b* of the arm portion 42 but may contact the arm portion 42 to apply a force to the contact arm 12 from the rear to lock the same.

Figure 8:
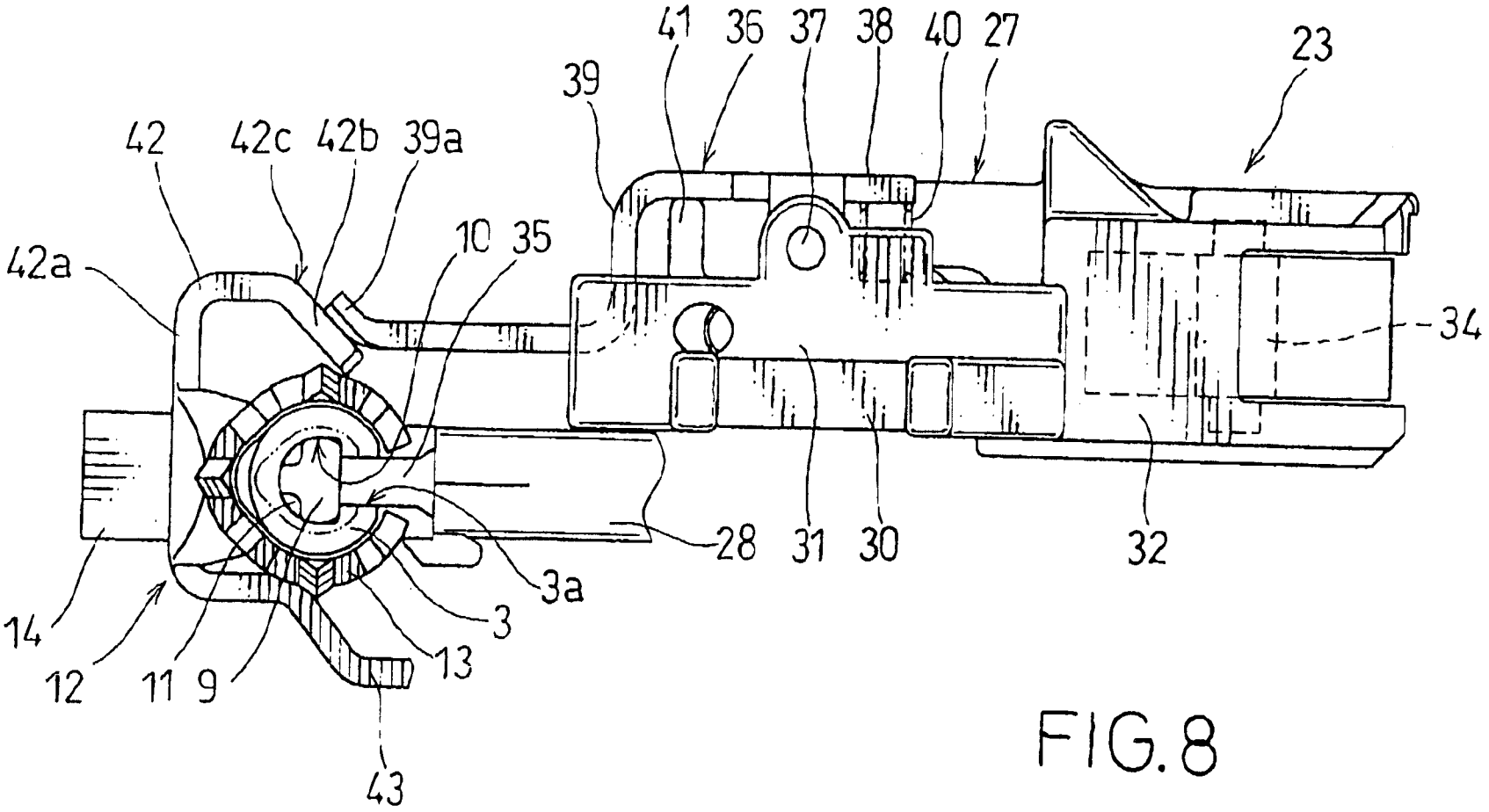
FIG. 8 is a bottom view similar to FIG. 4 and showing the operation when the engaging member has moved to contact the contact arm.
Figure 9:
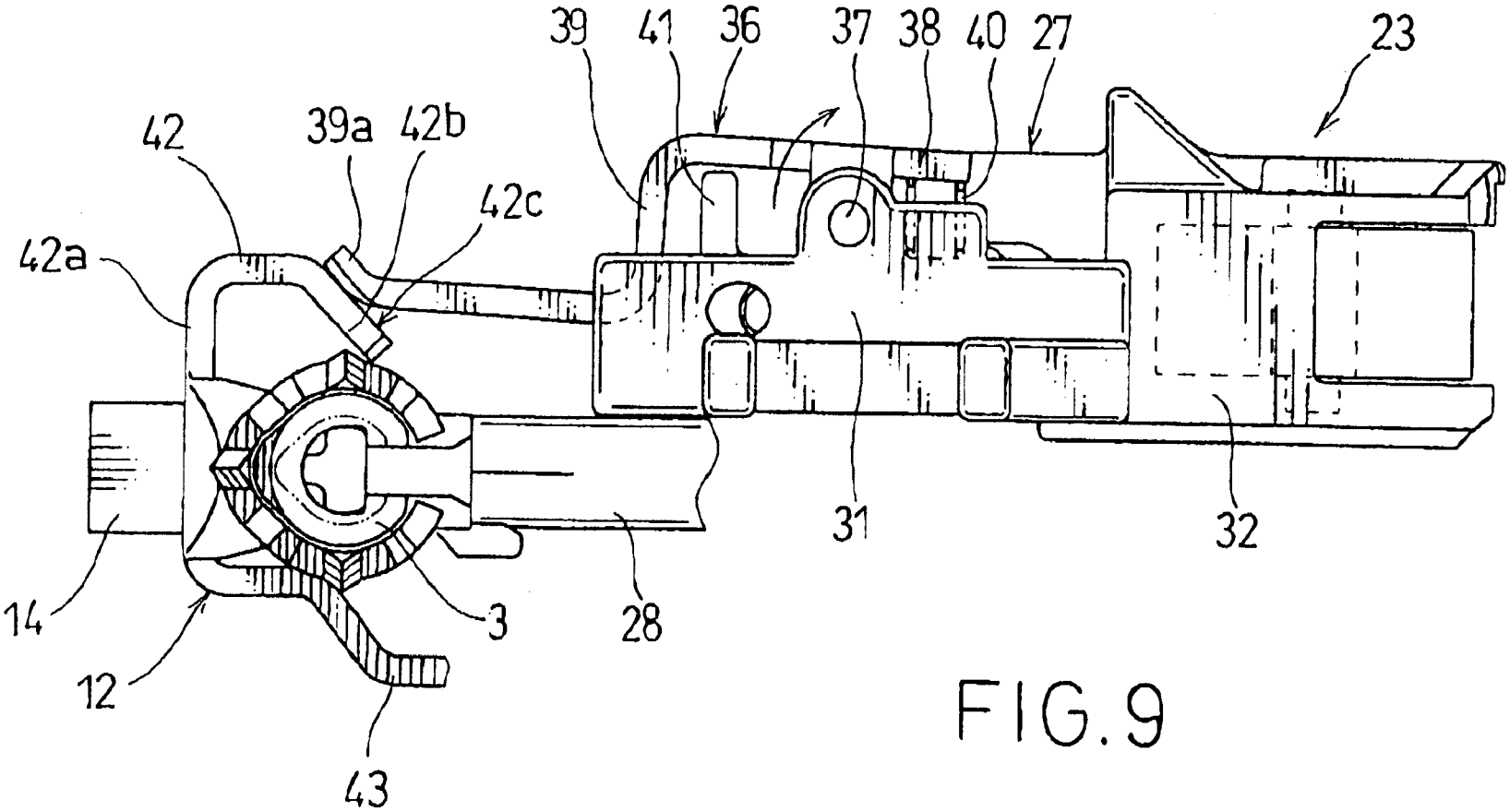
FIG. 9 is a bottom view similar to FIG. 8 and showing the operation when the engaging member has further moved against the contact arm so as to pivot relative to the pusher.

However, in the representative embodiment, (1) the engaging portion 39 can pivot about the pusher lever 27 by means of the pin 37, (2) the front end 39*a* of the engaging portion 39 is bent outward from the engaging portion 39 or from the moving direction of the engaging member 36 toward the contact arm 12, and (3) the inwardly bent part 42*b* is formed on the arm portion 42 of the contact arm 12. Therefore, when the engaging portion 39 moves forward to contact the outer surface 42*c* of the bent part 42*b* as shown in FIG. 8, a moment may be produced to pivot the engaging member 36 about the pin 37 by the reaction force applied by the outer surface 42*c* against the front end 39*a* of the engaging portion 39. As the engaging member 36 further moves forward, the front end 39*a* may move outward along the outer surface 42*c* to pivot the engaging member 36 against the biasing force of the compression coil spring 40. Therefore, the engaging member 36 pivots outward or the clockwise direction as shown in FIG. 9 to move away from the stopper 41.

Thus, the engaging member 36 may deviate from the direction toward the moving path of the contact arm 12 and may not apply a substantial force to the contact arm 12. As a result, the contact arm 12 should not be locked by the engaging member 36, and the contact arm 12 can reliably return to the lower stroke end position by the biasing force of the compression coil spring 45. Therefore, the operator can immediately restart the driving operation after new nails have been inserted into the magazine 4.

When the nails are to be driven at different positions in the same workpiece, it may be troublesome to return the contact arm 12 to the lower stroke end position by lifting the nail gun 1 after each driving operation. Therefore, the operator choose to utilize the "dragging" driving operation, in which the contact arm 12 is not returned to the lower stroke end position after each driving operation. Thus, after one nail has been driven into the workpiece, the operator continues to push the contact arm 12 against the workpiece such that the contact arm is held in the intermediate position between the upper and lower stroke end positions. Then, the operator moves or drags the nail gun 1 along the workpiece to the next driving position, in which the operator presses the contact arm 12 against the workpiece to move the contact arm 12 to the upper stroke end position. The operator thereafter pulls the trigger 8 to drive the nail.

During this particular driving operation, in the same manner as the normal driving operation described above, the engaging portion 39 does not move to the position above the inclined part 42*b* of the arm portion 42 but may contact the bent part 42*b* when the nail that has been driven is immediately before the predetermined last nail. However, because the engaging member 36 can pivot to deviate from the moving path of the contact arm 12 as described above, the contact arm 12 should not be locked by the engaging member 36. In particular, when the driving operation is performed using the dragging method, the engaging member 36 will inevitably move to contact the contact arm 12 because the contact arm 12 has not returned to the lower stroke end position.

Thus, in this representative embodiment, the hinge connection by the pin 37, the compression coil spring 40 and the outer surface 42*c* or the cam surface of the bent part 42*b* of the arm 42 may comprise a deviation device that may change the engaging member 36 from moving toward the moving path of the contact arm 12 and may prevent the engaging member 36 from contacting the contact arm 12 with a great force.

In addition, in this representative embodiment, although the engaging member 36 may change its path of movement, the engaging member 36 never stops moving. Therefore, the pusher 23 can be used as an actuator for the engaging member 36 in the same manner as the known nail gun. As a result, a separate drive device is not required for the engaging member 36 having the deviating function. Therefore, the nail gun 1 may have a simple construction.

Although in the above representative embodiment, the pusher 23 has been used as an actuator for the engaging member 36, a separate actuator can be incorporated for the engaging member 36. Such a separate actuator may operate based on signals from a first sensor and a second sensor (not shown). The first sensor may output a signal when the number of the nails in the magazine 4 has been reduced to the predetermined number. The second sensor may output a signal when the contact arm 12 is in the lower stroke end position. The actuator may move an engaging member to enter the moving path of the contact arm 12 only when both the first and second sensors output the signals. In this alternative embodiment, the engaging member is not required to perform a special movement such as a pivotal movement.

Figure 10:
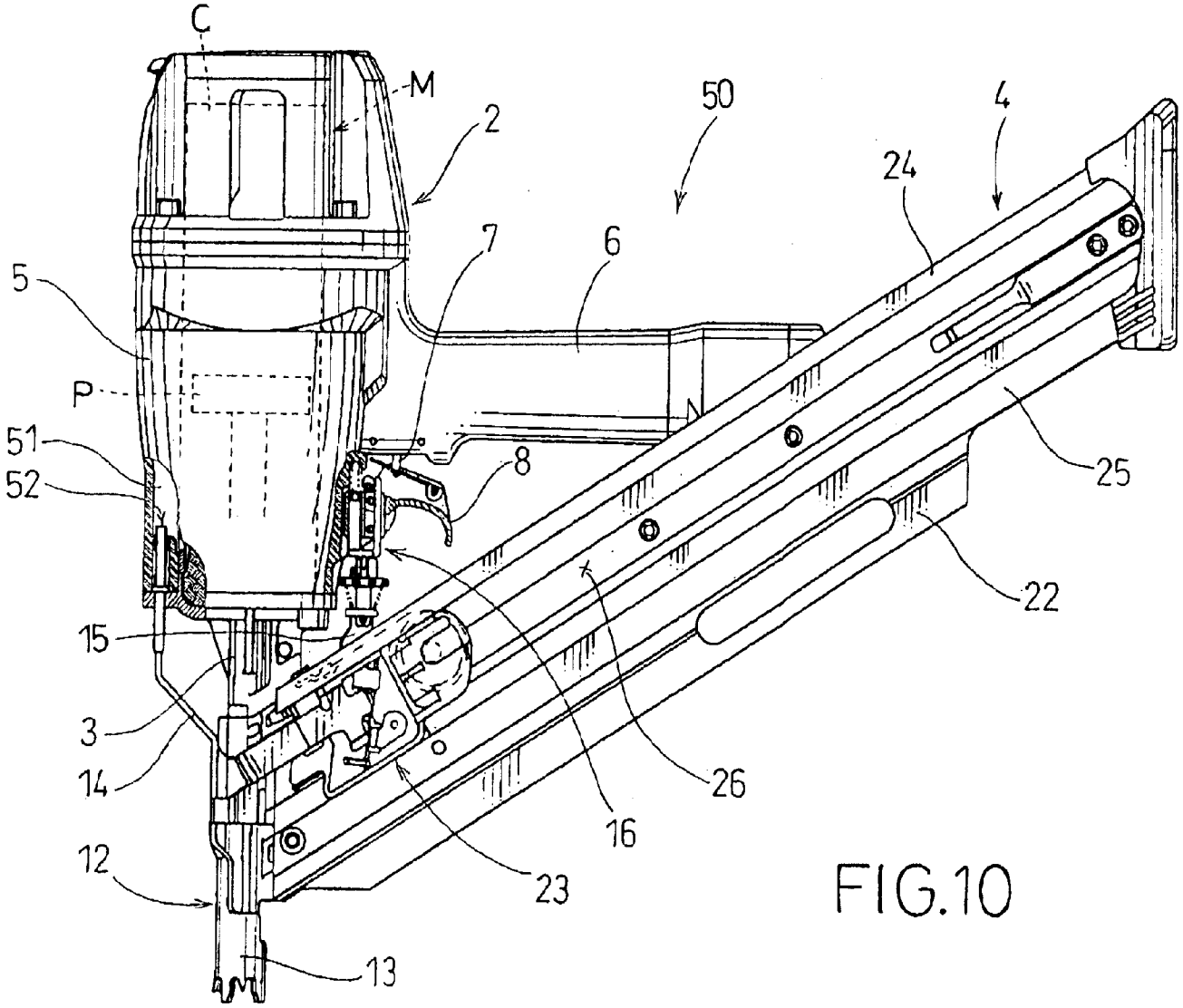
FIG. 10 is a side view of a second representative embodiment of an improved nail gun.
Figure 11:
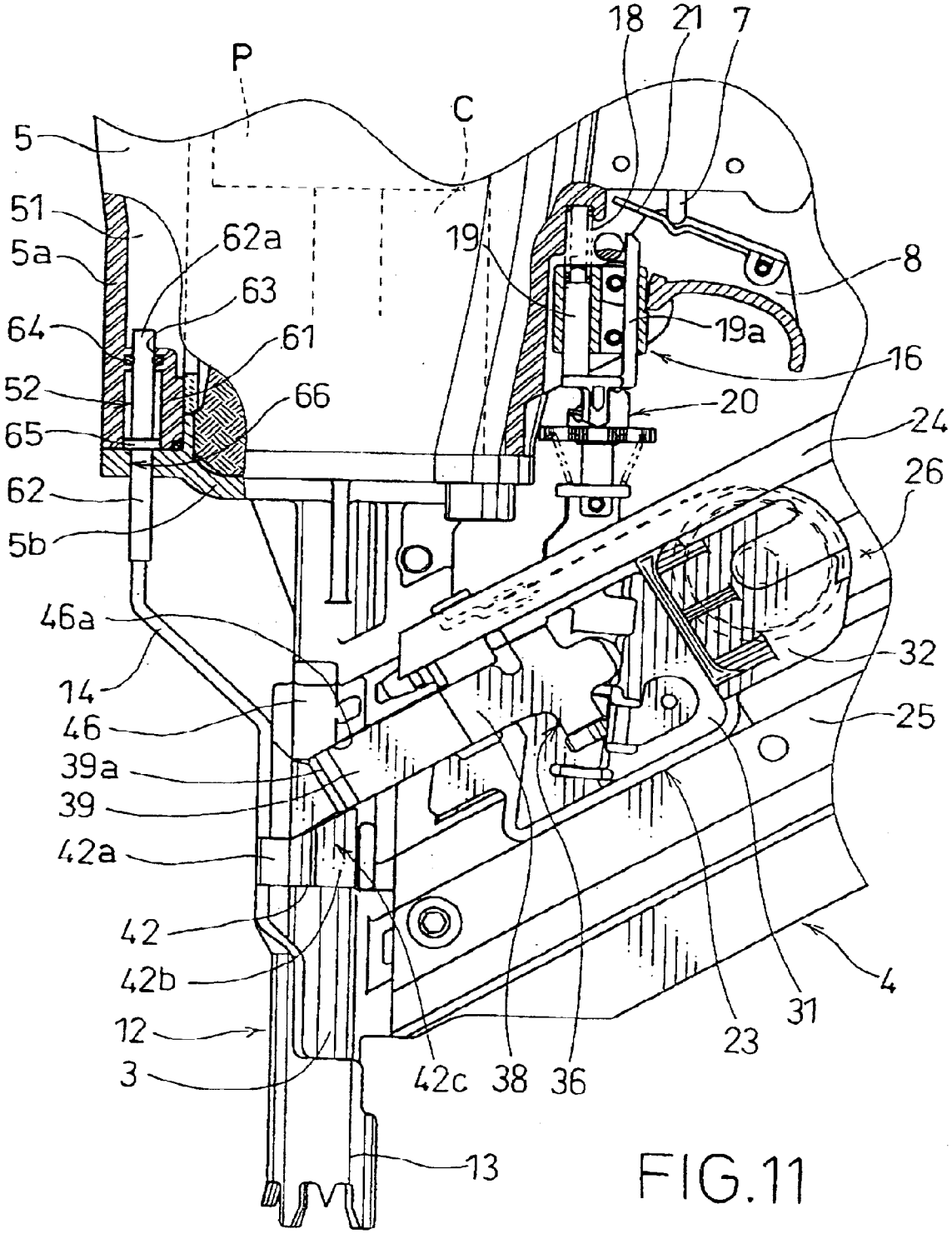
FIG. 11 is an enlarged view of a part of FIG. 10.

A second representative embodiment of a nail gun will now be described with reference to FIGS. 10 and 11 and is designated by reference numeral 50. The basic construction of the second representative embodiment is the same as the first representative embodiment. Therefore, the members in the second representative embodiment that are identical in the first representative embodiment will be given the same reference numerals.

Nail gun 50 may differ from the nail gun 1 of the first representative embodiment in that a plunger mechanism 52 can be incorporated in place of the compression coil spring 45 between the biasing rod 14 and the bottom surface of the body 2. The plunger mechanism 52 may be disposed adjacent to a return air chamber 51 that is formed within the main portion 5 of the naile gun body 2. The piston-cylinder mechanism M may be disposed within the main portion 5 as described in connection with the first representative embodiment.

Such a piston-cylinder mechanism M is generally known in this type of pneumatic nail guns. In addition, the return air chamber 51 is known to be associated with the piston-cylinder mechanism M. Therefore, the piston-cylinder mechanism M and the return air chamber 51 will be briefly explained.

When the stem 7 has been passed by the trigger 8, the trigger valve is opened, so that a head valve (not shown) of the piston-cylinder mechanism M is opened. As a result, compressed air is supplied from an air storage chamber (not shown) within the handle portion 6 to an upper piston chamber (not shown) within a cylinder C of the piston-cylinder mechanism M. Therefore, the piston P in the upper stroke end moves downward. Because the driver 9 is connected to the piston P, the driver 9 moves downward within the driver guide 3 so as to drive the nails as previously described. On the other hand, as the piston P moves downward, the compressed air within the upper piston chamber flows into the return air chamber 51 via a communication hole (not shown) formed in the cylinder C at a predetermined position, so that the compressed air may be temporarily stored in the return air chamber 51. The compressed air stored in the return air chamber 51 may be supplied to a lower piston chamber (not shown) within the cylinder C when the piston P reaches the lower stroke end. The operation for storing the compressed air in the return air chamber 51 and the operation for supplying the compressed air from the return air chamber 51 to the lower piston chamber may be alternatively performed by means of a valve device (not shown). Because the lower piston chamber partly communicates with the outside or the atmosphere, the compressed air supplied to the lower piston chamber may be discharged to the outside while it forces the piston P to move upward. The pressure within the return air chamber 51 returns to the atmospheric pressures when the piston P reaches substantially to the upper stroke end. As a result, one stroke movement of the piston P may be performed after each operation of the trigger 8 to open the trigger valve.

The plunger mechanism 52 may include a cylinder 61 and a plunger rod 62. The cylinder 61 may be positioned at the bottom of the return air chamber 51. The plunger rod 61 may be axially movable within the cylinder 61. The top wall and the side wall of the cylinder 61 may be formed integrally with a side wall 5*a* of the main portion 5 of the nail gun body. The bottom wall of the cylinder 61 may be formed integrally with a bottom wall 5*b* of the main portion 5. An upper portion 62*a* of the plunger rod 62 may extend into the return air chamber 51 through a slide support hole 63 formed in the top wall of the cylinder 61, so that the upper end surface of the upper portion 62*a* may serve as a pressure receiving surface, to which pressure from the return air chamber 61 may be applied. An O-ring 64 may be fitted into the slide support hole 63 so as to provide a seal against the plunger rod 62. A collar 65 may be formed on the plunger rod 62 and may be positioned within the cylinder 61. The collar 65 may serve as a stopper for defining a lower stroke end of the plunger rod 62. The lower portion of the plunger rod 62 may extend downward or outward from the bottom wall of the cylinder 61 through a support hole 66 and may be connected to the upper end of the biasing rod 14 of the contact arm 12. The space within the cylinder 61 may communicate with the outside via the support hole 66, and the collar 65 has a diameter slightly smaller than the diameter of the inner wall of the cylinder 61, so that a gap may exist between the collar 65 and the inner wall of the cylinder 61. Therefore, the space within the cylinder 61 can always be maintained at the atmosphere pressure.

The operation of the second representative embodiment will now be explained. After the nail has been driven by the driver 9, the compressed air is supplied to the return air chamber 51 in order to return the piston P of the piston-cylinder mechanism M to the upper stroke end position. Then, the pressure of the compressed air supplied to the return air chamber 51 may be applied to the upper end surface of the plunger rod 62 to press the plunger rod 62 downward. Therefore, the plunger rod 62 may produce a downward biasing force that is applied to the contact arm 12 downward via the biasing rod 14. As a result, the contact arm 12 in the upper stroke end position moves downward. The downward movement of the contact arm 12 may be stopped when the collar 63 of the plunger rod 62 contacts the bottom wall of the cylinder 61. The biasing force of the plunger 52 is not required to always be applied to the contact arm 12, but instead may be applied temporarily to the contact arm 12 when the piston P of the piston-cylinder mechanism M moves from the lower stroke end position to the upper stroke end position. Thus, the plunger mechanism 52 may serve as a returning device that temporarily operates after the nail has been driven and that serves to return the contact arm 12 to the lower stroke end position.

Therefore, the operation to lift the contact arm 12 by pressing the contact arm 12 against the workpiece can be easily performed to permit the driving operation. In addition, the operability of the nail gun 50 may not be degraded even if a great biasing force has been applied to the contact arm 12 by the plunger mechanism 52. Rather, by increasing the biasing force applied by the plunger mechanism 52, the contact arm 12 can reliably return to the lower stroke end position. The biasing force of the plunger mechanism 52 can be increased by increasing the diameter of the plunger rod 62 or by increasing the pressure receiving surface of the upper end of the plunger rod 62.

The contact arm 12 may be normally biased by the compression coil spring 18 that biases the control member 19 of the trigger control mechanism 16 as described in connection with the first representative embodiment. Therefore, the contact arm 12 can be held in the lower stroke end position by the biasing force of the compression coil spring 18. Because the biasing force of the compression coil spring 18 may have a small value, the movement of the contact arm 12 toward the upper stroke end position can be easily performed by pressing the contact arm 12 against the workpiece.

Although the second representative embodiment incorporates the engaging member 36 that can deviate from the moving path of the contact arm 12 as in the first representative embodiment, the engaging member can be fixed in position relative to the pusher as in the known idle driving prevention device. Thus, because the plunger mechanism 52 or the returning device may apply a great force to the contact arm 12, the contact arm 12 can reliably return to the lower stroke end position even if the engaging member contacts the contact arm 12 during the returning movement of the contact arm 12. Therefore, the operability can be improved in this respect.

In addition, because the pressurized air that drives the driver 9 is utilized as a drive source of the returning device, it is not necessary to incorporate a separate drive source for the returning device. Therefore, the nail gun 50 may have a simple construction and the manufacturing costs can be reduced. In particular, because the pressurized air with the return air chamber 51 may used as a drive source of the returning device, the construction of the nail gun can be further simplified. Thus, the return air chamber 51 is normally provided in this kind of pneumatic nail guns, and it is not necessary to incorporate a separate device for temporarily providing the compressed air to the returning device.

Of course, the plunger mechanism 52 may be replaced with a motor-driven actuator or a hydraulic actuator that may temporarily apply a biasing force to the contact arm 12 based on a signal from a sensor that may detect the driving of the nail by the driver 9.

What is claimed is:

1. A nail gun comprising:

a body;

a driver for driving nails;

a magazine for storing the nails;

a contact arm movable relative to the body between an upper first stroke end position and a lower second stroke end position, the contact arm preventing the nails from being driven by the driver when the contact arm is in the first stroke end position, said contact arm including a lateral extension;

a nail driving prevention device including a moveable engaging member, wherein the moveable engaging member enters the moving path of the contact arm so as to prevent the contact arm from moving from the first stroke end position toward the second stroke end position when a predetermined number of nails remain in the magazine;

a deviating device operable to engage said lateral extension to change the moving path of the engaging member away from the moving path of the contact arm when the contact arm is positioned above the first stroke end position; and a driver guide and a pusher, the driver guide being mounted on the body for guiding the driver and having a nail discharge opening at its lower end, the pusher including a base that is resiliently biased to move from a rear of the magazine toward the driver guide to feed the nails one after another from the magazine into the driver guide, and wherein the engaging member is mounted on the base and is movable to enter the moving path of the contact arm in such a manner that the engaging member crosses the moving path of the contact arm.

2. A nail gun as in claim 1 wherein the deviating device includes a hinge and a biasing member having a cam surface, the hinge connecting the engaging member to the pusher such that the engaging member can pivot between a first position directed toward the moving path of the contact arm and a second position directed to deviate from the moving path of the contact arm, the biasing member normally holding the engaging member to be directed to the first position, and the cam surface being formed on the engaging member for cooperation with the contact arm, so that the cam surface contacts and slides along an outer surface of the contact arm to pivot the engaging member from the first position to the second position against the biasing force of the biasing member when the engaging member moves toward the moving path of the contact arm with the contact arm positioned upward of the first stroke end position.

3. A nail gun as defined in claim 1 further including a backup wall provided for backing the engaging member on the side opposite to the contact arm when the engaging member enters the moving path of the contact arm.

4. A nail gun as defined in claim 1 further including a backup wall formed on the driver guide and serving to backup the engaging member on the side opposite to the contact arm which the engaging member enters the moving path of the contact arm.

5. A nail gun as defined in claim 1 wherein the contact arm is slidably movable along the driver guide.

6. An apparatus, comprising:

a body;

a fastener driver;

a fastener magazine;

an armature that moves relative to the body in a path between a first position and a second position, the armature preventing the fastener driver from driving fasteners into a workpiece when the armature is in the first position;

first means for preventing the armature from moving from the first position to the second position when a predetermined number of fasteners remain in the fastener magazine; and second means for deviating the first means moving path away from the armature moving path when the armature is positioned above the first position.

* * * * *